US008021391B2

(12) United States Patent
Minoguchi et al.

(10) Patent No.: US 8,021,391 B2
(45) Date of Patent: Sep. 20, 2011

(54) TOOTH-HARDENING APPARATUS

(75) Inventors: Kazumi Minoguchi, Saitama (JP); Keiichi Nakamura, Saitama (JP)

(73) Assignee: Combi Corporation, Tokyo-To (JP)

( * ) Notice: Subject to any disclaimer, the term of this patent is extended or adjusted under 35 U.S.C. 154(b) by 1131 days.

(21) Appl. No.: 10/827,446

(22) Filed: Apr. 20, 2004

(65) Prior Publication Data

US 2004/0210252 A1 Oct. 21, 2004

(30) Foreign Application Priority Data

Apr. 21, 2003 (JP) ..... 2003-116080
Apr. 21, 2003 (JP) ..... 2003-116083
Apr. 21, 2003 (JP) ..... 2003-116085

(51) Int. Cl.
*A61J 17/02* (2006.01)

(52) U.S. Cl. ..... 606/235

(58) Field of Classification Search ..... 606/234, 606/235; 601/136, 139; D24/194; 119/709–711; 15/110; D30/160
See application file for complete search history.

(56) References Cited

U.S. PATENT DOCUMENTS 1,117,093 A * 11/1914 Ripley ..... 606/235
2,532,116 A * 11/1950 Monaco ..... 446/419
D368,965 S * 4/1996 Nakata et al. ..... D24/194
6,305,326 B1 * 10/2001 Suchowski et al. ..... 119/709
2003/0181948 A1 * 9/2003 Dunn et al. ..... 606/235

FOREIGN PATENT DOCUMENTS

| | | | |
|---|---|---|---|
| GB | 2 288 126 | A * | 10/1995 |
| JP | 35-24641 | U | 9/1960 |
| JP | 35-34030 | U | 12/1960 |
| JP | 47-17632 | U | 10/1972 |
| JP | 48-38478 | U | 5/1973 |
| JP | 06-339514 | A | 12/1994 |
| JP | 2000-279487 | A | 10/2000 |
| JP | 2001-187117 | A | 7/2001 |
| JP | 3260243 | B | 12/2001 |

* cited by examiner

*Primary Examiner* — Ryan Severson

(74) *Attorney, Agent, or Firm* — Birch, Stewart, Kolasch & Birch, LLP

(57) ABSTRACT

A tooth-hardening apparatus 10 according to the present invention includes a tooth-hardening member 11 of a plate shape having a projection 13 on its surface, and a nipple 15 attached on the tooth-hardening member 11. The nipple has a predetermined hardness to provide a pacifier function and a tooth-hardening function. A space 21 is formed in the tooth-hardening member 11. The space 21 is covered with an upper transparent cover 18 and a lower transparent cover 19.

7 Claims, 7 Drawing Sheets

TOOTH-HARDENING APPARATUS

This Non-provisional application claims priority under 35 U.S.C.§119(a) on Patent Application No(s). 2003-116080; 2003-116083; and 2003-116085 filed in Japan on Apr. 21, 2003, the entire contents of which are hereby incorporated by reference.

BACKGROUND OF THE INVENTION

1. Field of the Invention

The present invention relates to a tooth-hardening apparatus used by an infant for hardening his or her teeth.

2. Background Art

A several-month-old baby should gradually harden his or her teeth through training. Some tooth-hardening apparatuses have been conventionally used for such tooth-hardening training (see, for example, Japanese Patent Laid-Open Publication No. 2000-279487).

As described above, some tooth-hardening apparatuses have been conventionally developed. A period when an infant hardens his or her teeth partially overlaps a period when an infant continues to suck a nipple. Thus, if an infant can harden his or her teeth, while continuing a sucking motion, it is possible for the infant to smoothly shift to a tooth-hardening training, and this is advantageous for the infant.

SUMMARY OF THE INVENTION

The present invention is made in view of the above. It is an object of the present invention to provide a tooth-hardening apparatus with which an infant can harden its teeth through training, while the infant continues a sucking motion.

A tooth-hardening apparatus according to the present invention comprises: a tooth-hardening member of a plate shape having a projection on its surface; and a nipple attached on the tooth-hardening member; wherein the nipple has a predetermined hardness to provide a pacifier function and a tooth-hardening function.

According to the present invention, a gripping opening is disposed on both sides of the nipple on the tooth-hardening member.

According to the present invention, the tooth-hardening member has a space formed substantially in the center portion of the tooth-hardening member, the space being covered with a transparent cover, and the nipple is coupled to the tooth-hardening member through the transparent cover.

According to the present invention, a plurality of colored balls are contained in the space covered with the transparent cover.

According to the present invention, the transparent cover is provided with a drain hole.

A tooth-hardening apparatus according to the present invention comprises: a first tooth-hardening member of a plate shape having a first surface provided with a plurality of first projections; and a second tooth-hardening member of a plate shape having a second surface provided with a plurality of second projections; wherein the second tooth-hardening member is arranged at a periphery of the first tooth-hardening member in parallel to the second tooth-hardening member, and the first surface of the first tooth-hardening member and the second surface of the second tooth-hardening member are formed of respective materials which have hardnesses different from each other.

According to the present invention, the first hardening member has a space formed substantially in the center portion of the first tooth-hardening member, the space being covered with a transparent cover.

According to the present invention, a plurality of colored balls are contained in the space covered with the transparent cover.

According to the present invention, the transparent cover is provided with a drain hole.

According to the present invention, a gripping opening is disposed on the first tooth-hardening member.

A tooth-hardening apparatus according to the present invention comprises: a first tooth-hardening member of substantially a plate shape having a first surface provided with a plurality of first projections; a second tooth-hardening member of substantially a plate shape having a second surface provided with a plurality of second projections, and being arranged in parallel to the first tooth-hardening member; and a coupling member for coupling the first tooth-hardening member to the second tooth-hardening member; wherein the first surface of the first tooth-hardening member and the second surface of the second tooth-hardening member are formed of respective materials which have hardnesses different from each other.

According to the present invention, the first tooth-hardening member has a space formed substantially in the center portion of the first tooth-hardening member, the space being covered with a transparent cover.

According to the present invention, a plurality of colored balls are contained in the space covered with the transparent cover.

According to the present invention, the transparent cover is provided with a drain hole.

According to the present invention, the coupling member is composed of a plurality of curved members.

According to the present invention, at least one of the first and second tooth-hardening members is so configured as to firstly come close to the other member from the center portion toward the periphery, and then to separate from the other member.

DETAILED DESCRIPTION OF THE INVENTION

First Embodiment

Embodiments of the present invention are described below with reference to the drawings. FIGS. 1 to 4 are views showing a first embodiment of a tooth-hardening apparatus according to the present invention.

Figure 1:
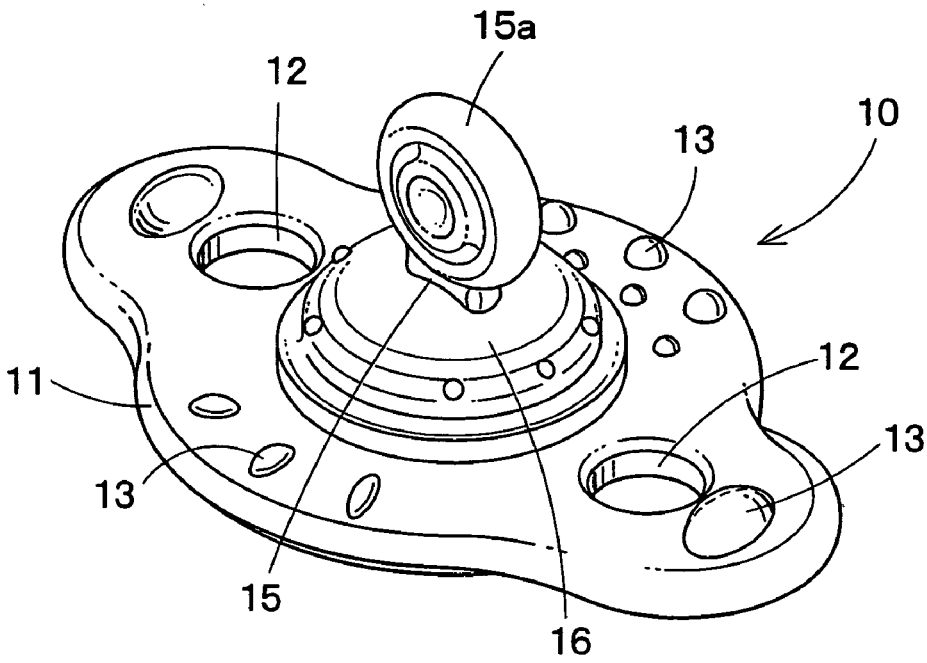
FIG. 1 is a perspective view of a first embodiment of a tooth-hardening apparatus according to the present invention.
Figure 2:
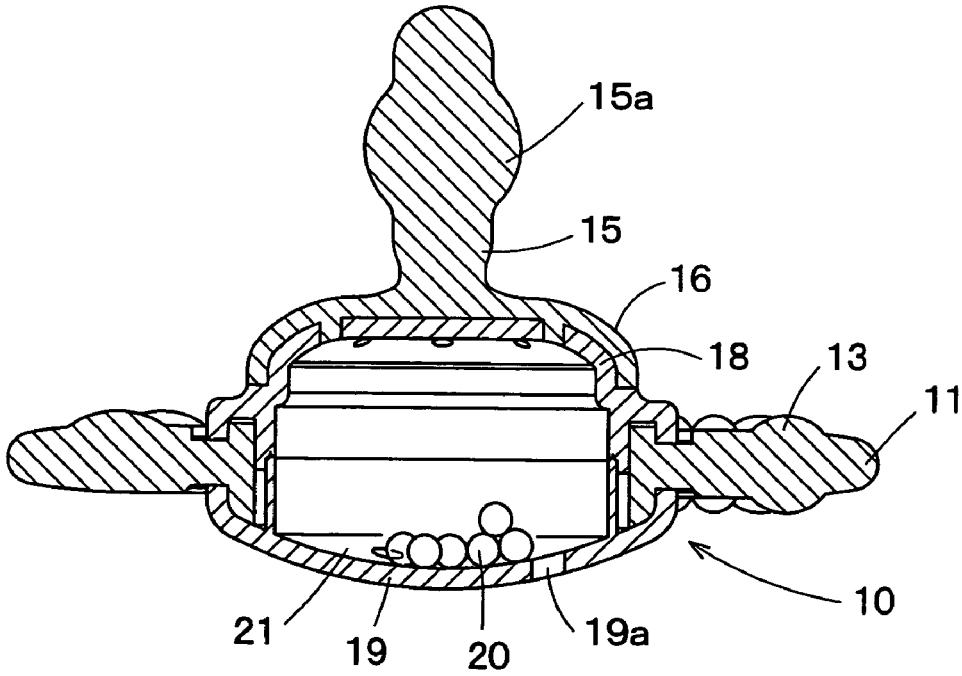
FIG. 2 is a side cross-sectional view of the first embodiment of the tooth-hardening apparatus according to the present invention.
Figure 3:
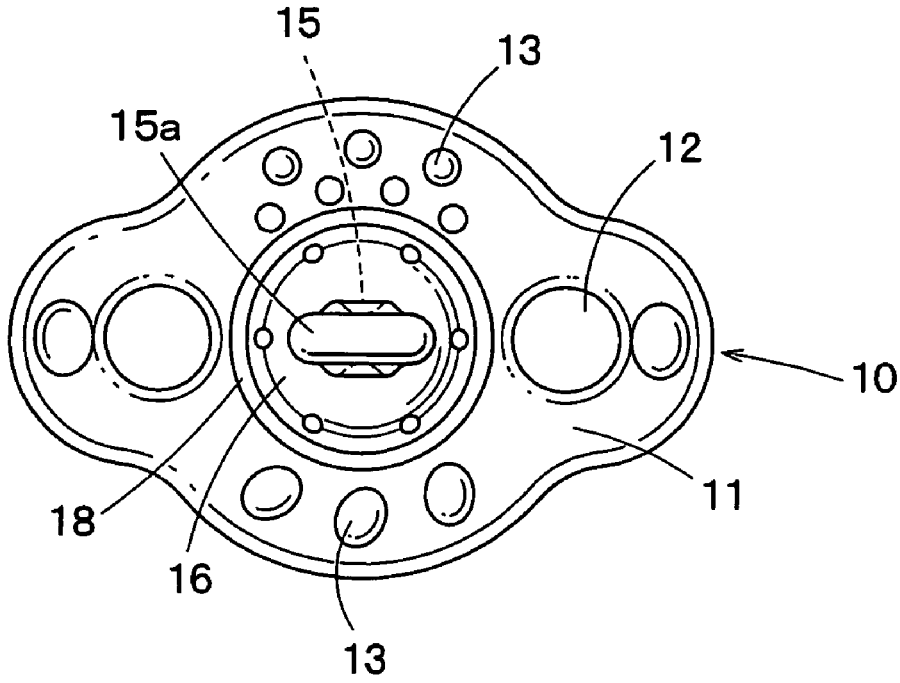
FIG. 3 is a top view of the first embodiment of the tooth-hardening apparatus according to the present invention.
Figure 4:
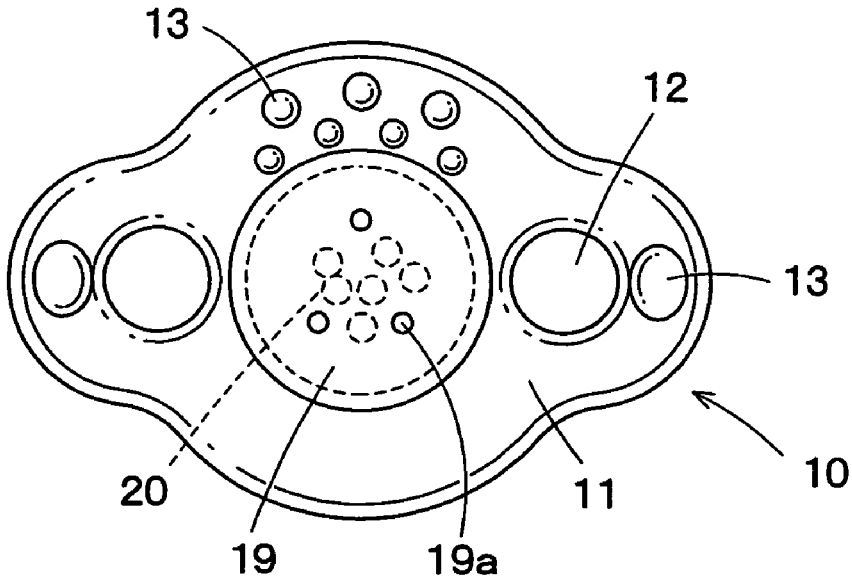
FIG. 4 is a bottom view of the first embodiment of the tooth-hardening apparatus according to the present invention.

FIG. 1 is a perspective view showing a tooth-hardening apparatus, FIG. 2 is a side cross-sectional view thereof, FIG. 3 is a top view thereof, and FIG. 4 is a bottom view thereof.

FIGS. 1 to 4 show a tooth-hardening apparatus 10 which is used by an infant for a tooth-hardening training. The tooth-hardening apparatus 10 includes a tooth-hardening member 11 of a plate shape having a plurality of projections 13 on its upper and lower surfaces, and a nipple 15 attached substantially on a center portion of the tooth-hardening member 11.

The tooth-hardening member 11 is of substantially a rhombus shape as a whole. Gripping openings 12, 12 to be gripped by an infant are disposed on both sides of the nipple 15.

The tooth-hardening member 11 is formed of a material such as TPE (thermoplastic elastomer), and has a hardness (JIS K 6253 A) of 65°.

The tooth-hardening member 11 is chewed by an infant for a tooth-hardening training. As described above, the plurality of projections 13 are formed on the surfaces of the tooth-hardening member. The projections 13 can facilitate a tooth-hardening training.

Not limited to a particular shape, the projections 13 can be formed in larger and smaller shapes.

The nipple 15 has a nipple body 15*a* and a holding part 16 holding the nipple body 15*a*. The nipple 15 as a whole is formed of a material such as TPE, and has a hardness (JIS K 6253 A) of 55°.

The nipple body 15*a* of the nipple 15 is sucked by an infant as a pacifier, as well as chewed by the same for providing a tooth-hardening training.

A three or four-month-old infant sucks the nipple body 15*a* of the nipple 15 as a pacifier. At the same time, the infant must harden his or her teeth through training from this period. As described above, the nipple body 15*a* of the nipple 15 has a predetermined hardness to provide a pacifier function and a tooth-hardening function. Thus, an infant sucks the nipple 15 as a pacifier, while smoothly shifting to a training for hardening his or her teeth is possible.

In addition to the nipple body 15*a* of the nipple 15, an infant can also use the tooth-hardening member 11 to harden his or her teeth through the training.

The tooth-hardening member has a space 21 formed substantially in the center portion thereof. The space 21 is covered with an upper transparent cover 18 and a lower transparent cover 19. The nipple 15 is attached on the tooth-hardening member 11 through the upper transparent cover 18.

The upper transparent cover 18 and the lower transparent cover 19 are described below with reference to FIG. 2.

As shown in FIG. 2, the space 21 formed substantially in the center portion of the tooth-hardening member 11 is covered with the upper transparent cover 18 and the lower transparent cover 19. A plurality of colored balls are contained in the space 21.

When an infant moves the tooth-hardening apparatus 10, the colored balls 20 are moved in the space 21, so that the infant can enjoy itself.

The lower transparent cover 19 is provided with a plurality of drain holes 19*a*. The upper transparent cover 18 and the lower transparent cover 19 are formed of a material such as PP (polypropylene).

Manufacturing steps of the tooth-hardening apparatus 10 is described below.

First, a tooth-hardening member 11 having projections 13 on its surface is prepared. A nipple 15 and an upper transparent cover 18 are simultaneously molded by means of a two-color molding. At the same time, a lower transparent cover 19 having holes 19*a* is prepared.

Then, the nipple 15 and the upper transparent cover 18 are positioned above, and the lower transparent cover 19 is positioned below, with the tooth-hardening member 11 being disposed therebetween. A plurality of colored balls 20 are contained in a space 21 between the upper transparent cover 18 and the lower transparent cover 19.

Finally, the upper transparent cover 18 and the lower transparent cover 19 are joined to the tooth-hardening member 11 by an ultrasonic seal. In this way, a tooth-hardening apparatus 10 can be obtained.

When used, an infant can suck the nipple body 15*a* of the nipple 15 as a pacifier, while chewing the nipple 15*a* to harden his or her teeth through the training. As a result, an infant can smoothly shift from a sucking motion to a tooth-hardening training.

Further, an infant can chew the tooth-hardening member 11 for a further tooth-hardening training.

When an infant moves the tooth-hardening apparatus 10, the colored balls 20 are moved in the space 21, so that the infant can play with the tooth-hardening apparatus 10 as a toy.

After the tooth-hardening apparatus 10 is used by an infant for a long time, the tooth-hardening apparatus 10 is entirely sterilized by boiling the tooth-hardening apparatus 10. At this time, water vapor may enter the space 21. The water vapor can be discharged through the holes 19*a* as water droplets.

When the colored balls 20 are moved in the space 21, the holes 19*a* have such a function that emits enjoyable sounds by resonating a rattle generated by the colored balls 20.

As described above, according to this embodiment, an infant can continue to suck a nipple as a pacifier, while hardening his or her teeth the through training. Therefore, an infant can smoothly shift to a tooth-hardening training, while he or she continues a sucking motion.

Second Embodiment

A second embodiment of the present invention is described below with reference to the drawings. FIGS. 5 to 10 are views showing the second embodiment of a tooth-hardening apparatus according to the present invention.

Figure 5:
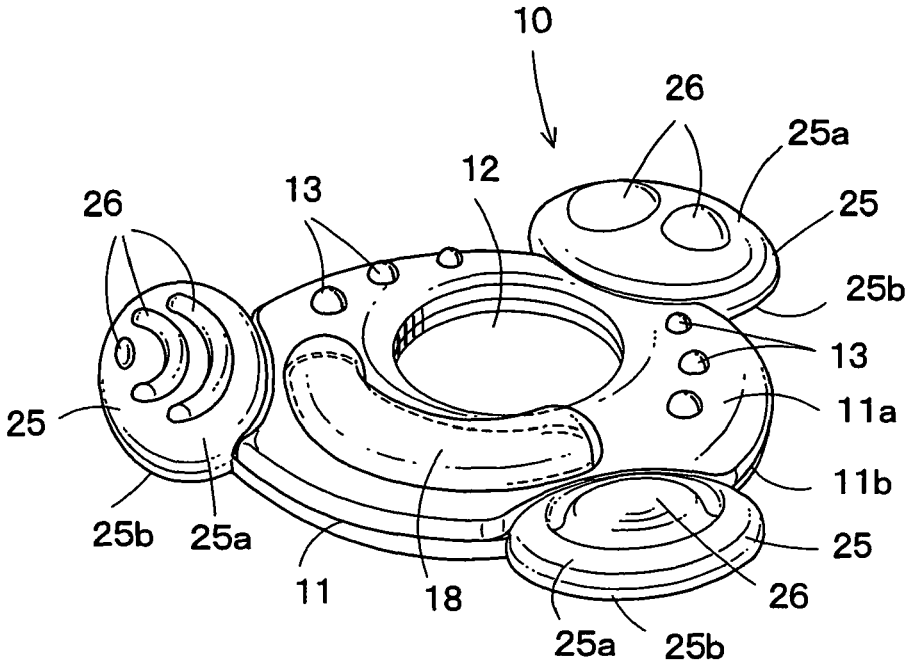
FIG. 5 is a perspective view of a second embodiment of a tooth-hardening apparatus according to the present invention.
Figure 6:
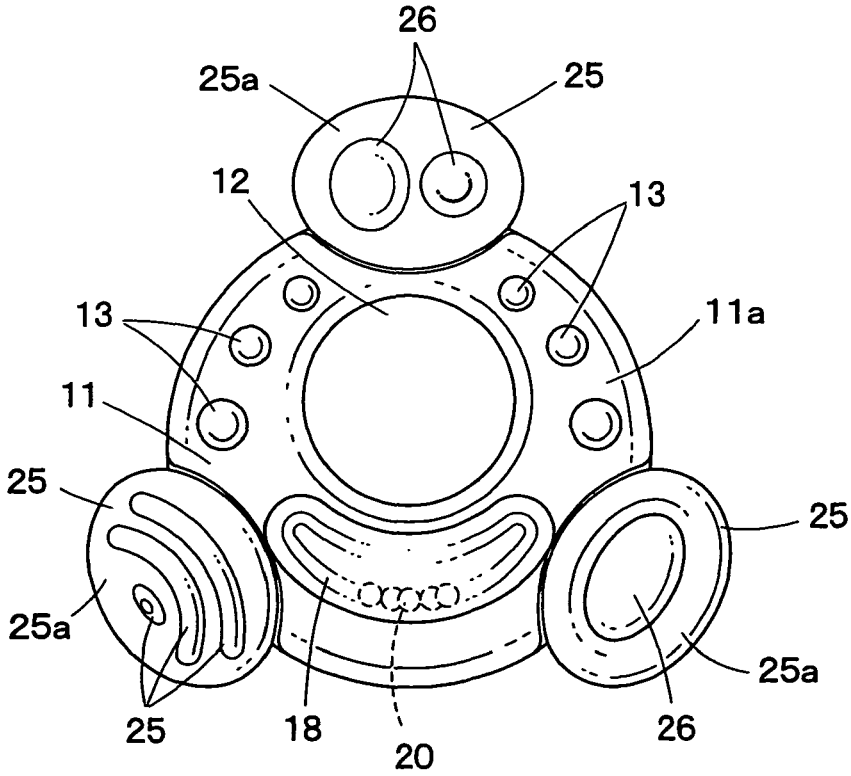
FIG. 6 is a top view of the second embodiment of the tooth-hardening apparatus according to the present invention.
Figure 7:
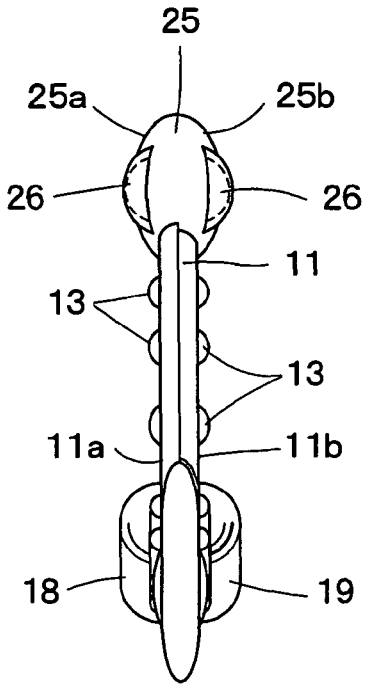
FIG. 7 is a side view of the second embodiment of the tooth-hardening apparatus according to the present invention as viewed from one direction.
Figure 8:
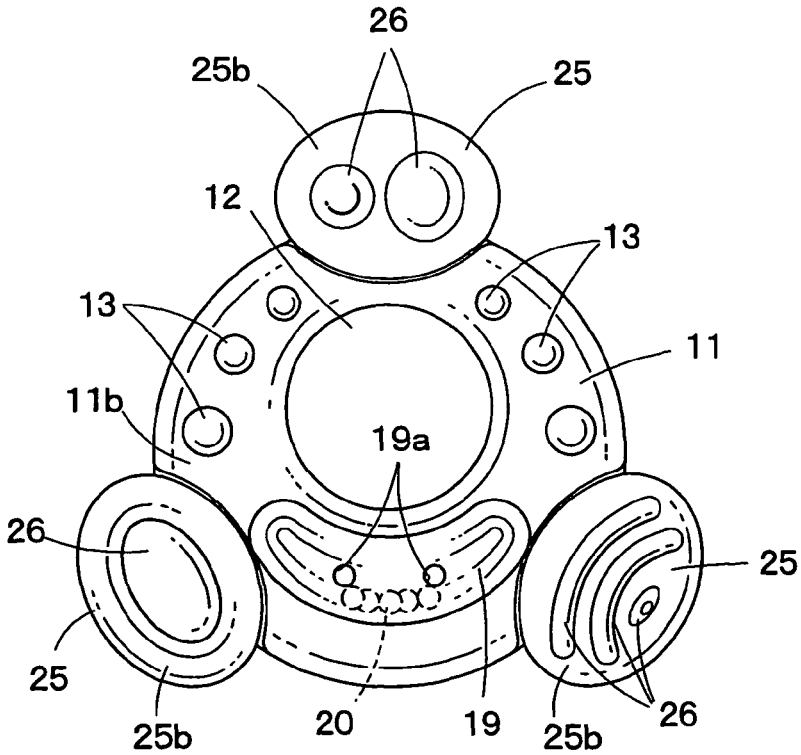
FIG. 8 is a bottom view of the second embodiment of the tooth-hardening apparatus according to the present invention.
Figure 9:
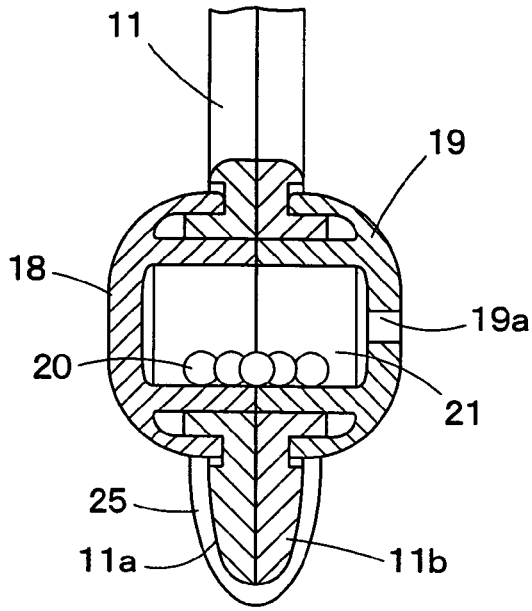
FIG. 9 is an enlarged side cross-sectional view of an upper transparent cover and a lower transparent cover of the tooth-hardening apparatus according to the present invention.

FIG. 5 is a perspective view of the tooth-hardening apparatus, FIG. 6 is a top view thereof, FIG. 7 is a side view thereof, FIG. 8 is a bottom view thereof, and FIG. 9 is an enlarged side cross-sectional view thereof.

FIGS. 5 to 9 show a tooth-hardening apparatus 10 which is used by an infant for a tooth-hardening training. The tooth-hardening apparatus 10 includes a first tooth-hardening member 11 of a plate shape, and a second tooth-hardening member 25 of a plate shape arranged at a periphery of the first tooth-hardening member 11. A plurality of, for example, three tooth-hardening members 25 are arranged at the periphery of the first tooth-hardening member 11.

The first tooth-hardening member 11 is generally of substantially a round shape. A gripping opening 12 to be gripped by an infant is formed substantially in the center portion of the first tooth-hardening member 11. Each of the second tooth-hardening members 25 is of an oval shape, and is slightly thicker than the first tooth-hardening member 11. The tooth-hardening members 25 are arranged at the periphery of the first tooth-hardening member 11 at an interval equal to each other.

The first tooth-hardening member 11 has a front surface 11*a* and a rear surface 11*b*. A first projection 13 is disposed on the front surface 11*a* and the rear surface 11*b*. The second tooth-hardening member 25 has a front surface 25*a* and a rear surface 25*b*. A second projection 26 is disposed on the front surface 25*a* and the rear surface 25*b*.

The front surface 11*a* and the rear surface 1*b* of the first tooth-hardening member 11 are formed of a material different from that of the front surface 25*a* and the rear surface 25*b* of the second tooth-hardening member 25.

In this embodiment, the front surface 11*a* and the rear surface 11*b* of the first tooth-hardening member 11 are formed of a material such as TPE (thermoplastic elastomer), and has a hardness (JIS K 6253 A) of 88°. The front surface 25*a* and the rear surface 25*b* of the second tooth-hardening member 25 are formed of a material such as TPE, and has a hardness (JIS K 6253 A) of 65°.

Thus, the front surface 11*a* and the rear surface 11*b* of the first tooth-hardening member 11 are harder than the front surface 25*a* and the rear surface 25*b* of the second tooth-hardening member 25.

In this embodiment, the front surface 11*a* of the first tooth-hardening member 11 provides a first surface, and the front surface 25*a* of the second tooth-hardening members 25 provides a second surface.

Both the first projection 13 of the first tooth-hardening member 11 and the second projection 26 of the second tooth-hardening members 25 have a plurality of bosses. The bosses are of various sizes and shapes such as rounded shapes, linear shapes. A size, shape, and number of the bosses are not particularly limited.

As described above, the front surface (first surface) 11*a* and the rear surface 11*b* of the first tooth-hardening member 11 has a higher hardness than that of the front surface (second surface) 25*a* and the rear surface 25*b* of the second tooth-hardening member 25. A five-month-old infant can chew the front surface 25*a* and the rear surface 25*b* of the softer second tooth-hardening member 25 to harden his or her teeth through the training. A seven-month-old infant can chew the front surface 11*a* and the rear surface 11*b* of the harder first tooth-hardening member 11 to harden his or her teeth through training.

Although the first teeth-hardening member 11 is generally formed of a harder material, only the front surface 11*a* is formed of a harder material, while the rear surface 11*b* may be formed of a softer material. On the other hand, although the second teeth-hardening members 25 is generally formed of a softer material, only the front surface 25*a* may be formed a softer material, while the rear surface 25*b* is formed of a harder material.

The first tooth-hardening member 11 has a space 21 formed between the gripping opening 12 and the periphery of the first tooth-hardening member 11. The space 21 is covered with an upper transparent cover 18 and a lower transparent cover 19.

Structures of the upper transparent cover 18 and the lower transparent cover 19 are described below with reference to FIG. 9. As shown in FIG. 9, the space 21 formed in the first tooth-hardening member 11 is covered with the upper transparent cover 18 and the lower transparent cover 19. A plurality of colored balls are contained in the space 21.

When an infant moves the tooth-hardening apparatus 10, the colored balls 20 are moved in the space 21, so that the infant can enjoy these.

The lower transparent cover 19 is provided with a plurality of drain holes 19*a*. The upper transparent cover 18 and the lower transparent cover 19 are formed of a material such as PP (polypropylene).

Manufacturing steps of the tooth-hardening apparatus 10 is described below.

First, a first tooth-hardening member 11 having first projections 13 on a front surface 11*a* and a rear surface 1*b*, and a second tooth-hardening member 25 having second projections 26 on a front surface 25*a* and a rear surface 25*b* are molded. Since the front surface 11*a* and the rear surface 11*b* of the first tooth-hardening member 11 are formed of a material different from that of the front surface 25*a* and the rear surface 25*b* of the second tooth-hardening member 25, the first tooth-hardening member 11 and the second tooth hardening member 25 are molded by means of a two-color molding. At the same time, an upper transparent cover 18 and a lower transparent cover 19 are prepared.

Then, the upper transparent cover 18 is positioned above, and the lower transparent cover 19 is positioned below, with the tooth-hardening member 11 being disposed therebetween. A plurality of colored balls 20 are contained in a space 21 between the upper transparent cover 18 and the lower transparent cover 19.

Finally, the upper transparent cover 18 and the lower transparent cover 19 are joined to the tooth-hardening member 11 by an ultrasonic seal. In this way, a tooth-hardening apparatus 10 can be obtained.

When used, a five-month-old infant can chew the front surface (second surface) 25*a* and the rear surface 25*b* of the softer second tooth-hardening member 25 to harden its teeth through training.

A seven-month-old infant can chew the front surface (first surface) 11*a* and the rear surface 11*b* of the harder first tooth-hardening member 11 to further harden his or her teeth through the training.

In the case where the front surface 11*a* and the rear surface 11*b* of the first tooth-hardening member 11 have hardnesses different from each other, when an infant chews the tooth-hardening apparatus 10 upside down, a more variety of stimulations can be given to upper and lower alveolar arches, upper and lower lips, and a tongue. Thus, the tooth-hardening training can be smoothly carried out.

When an infant moves the tooth-hardening apparatus 10, the colored balls 20 are moved in the space 21, so that the infant can play with the tooth-hardening apparatus 10 as a toy.

After the tooth-hardening apparatus 10 is used by an infant for a long time, the tooth-hardening apparatus 10 is entirely sterilized by boiling the tooth-hardening apparatus 10. At this time, water vapor may enter the space 21. The water vapor can be discharged through the holes 19*a* as water droplets.

When the colored balls 20 are moved in the space 21, the holes 19*a* have such a function that emits enjoyable sounds by resonating a rattle generated by the colored balls 20.

As described above, according to the present invention, an infant can proceed, corresponding to its growing step, from a step where it chews the front surface 25*a* and the rear surface 25*b* of the softer second tooth-hardening member 25, to a step where it chews the front surface 11*a* and the rear surface 11*b* of the harder first tooth-hardening member 11. Therefore, an infant can harden his or her teeth through the training corresponding to its growing step by using a single tooth-hardening apparatus.

Third Embodiment

An embodiment of the present invention is described below with reference to the drawings. FIGS. 10 to 13 are views showing a third embodiment of a tooth-hardening apparatus of the present invention.

Figure 10:
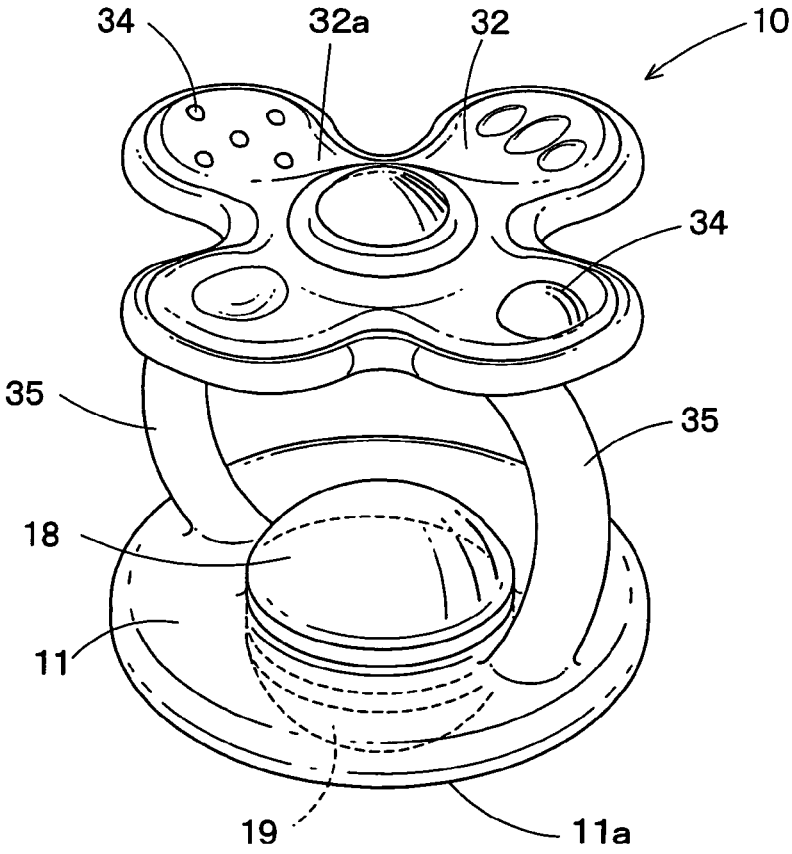
FIG. 10 is a perspective view of a third embodiment of a tooth-hardening apparatus according to the present invention.
Figure 11:
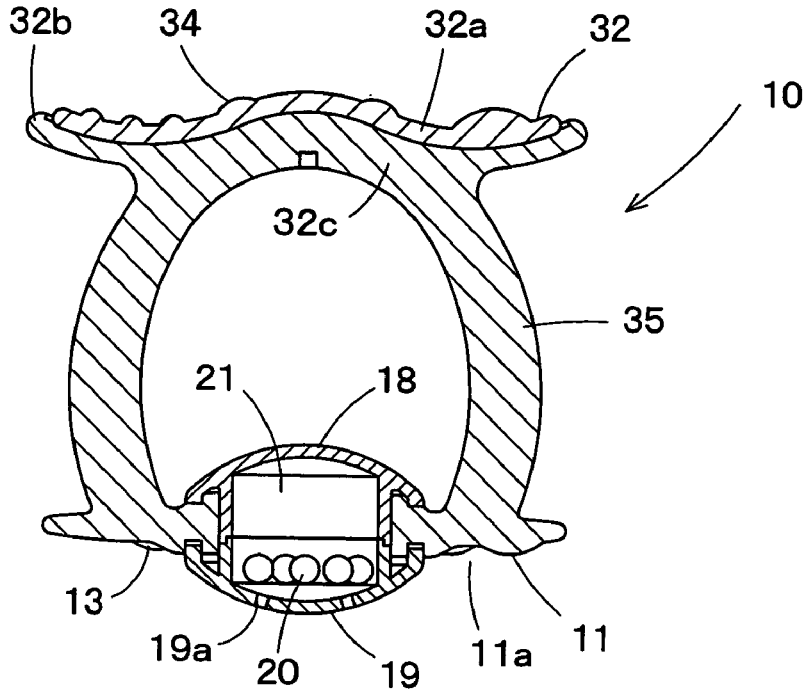
FIG. 11 is a side cross-sectional view of the third embodiment of the tooth-hardening apparatus according to the present invention as viewed from one direction.
Figure 12:
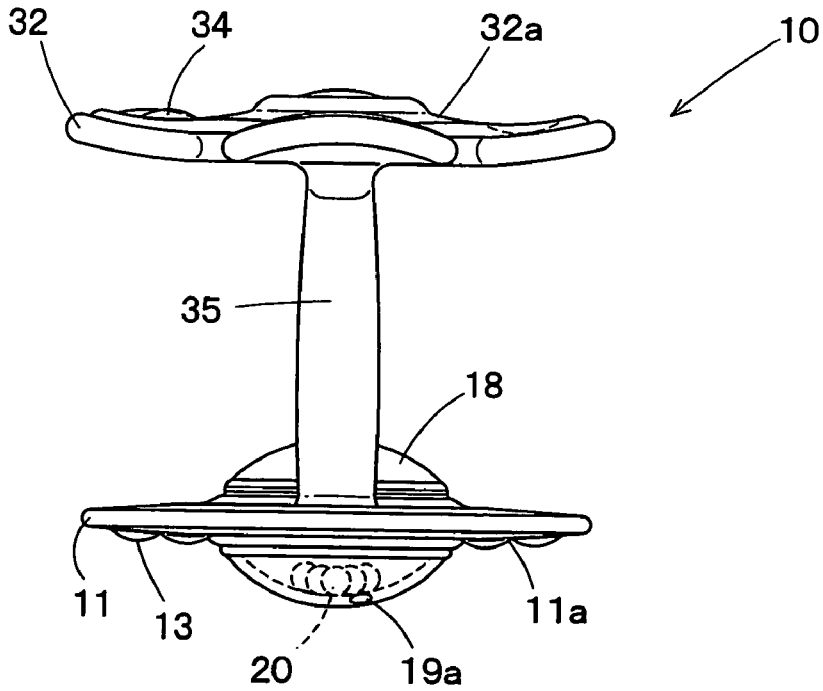
FIG. 12 is a side view of the third embodiment of the tooth-hardening apparatus according to the present invention as viewed from the other direction.
Figure 13:
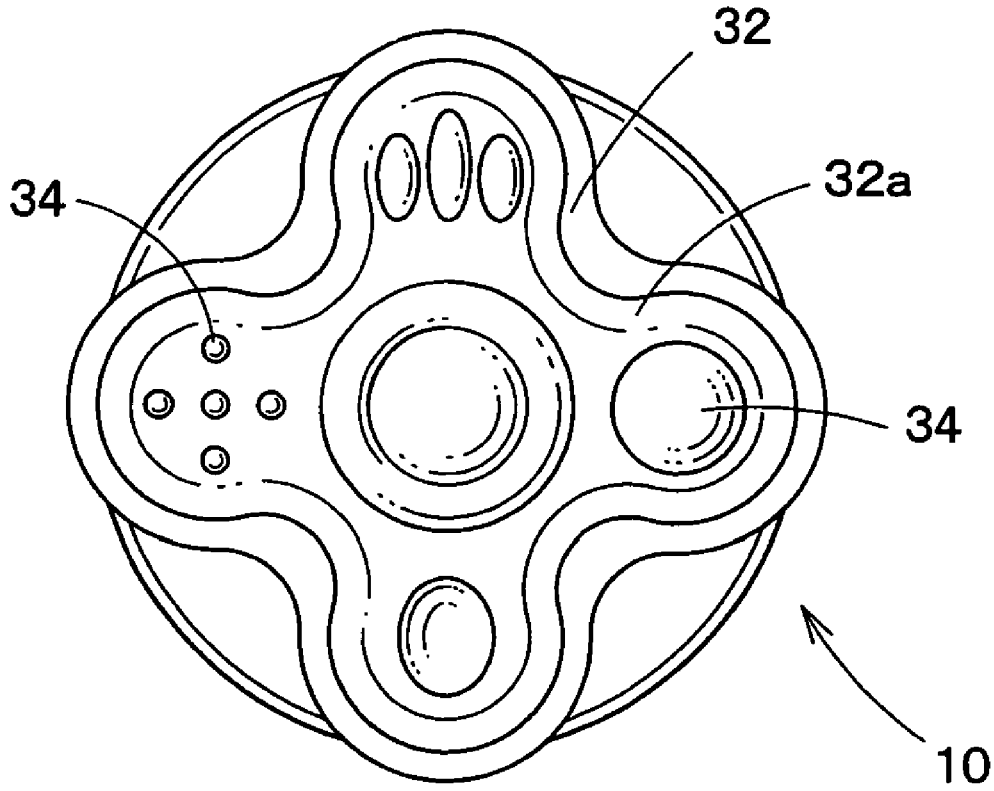
FIG. 13 is a top view of the third embodiment of the tooth-hardening apparatus according to the present invention.

FIG. 10 is a perspective view of a tooth-hardening apparatus, FIG. 11 is a side cross-sectional view thereof as viewed from one direction, FIG. 12 is a side view thereof as viewed from the other direction, and FIG. 13 is a top view thereof.

FIGS. 10 to 13 show a tooth-hardening apparatus 10 which is used by an infant for a tooth-hardening training. The tooth-hardening apparatus 10 includes a first tooth-hardening member 11 of substantially a plate shape, a second tooth-hardening member 32 of substantially a plate shape arranged in parallel to the first tooth-hardening member 11, and coupling members 35 for coupling the first tooth-hardening member 11 to the second tooth-hardening member 32.

As shown in FIG. 10, the first tooth-hardening member 11 has a first face 11*a* facing downward. A plurality of first projections 13 are disposed on the first surface 11*a*. The second tooth-hardening member 32 has a second surface 32*a* facing upward. A plurality of second projections 34 are disposed on the second surface 32*a*.

Not limited to a particular shape, both the first projections 13 on the first surface 11*a* and the second projections 34 on the second surface 32*a* are formed in larger and smaller shapes.

Two coupling members 35, each coupling the first tooth-hardening member 11 to the second tooth-hardening member 32 are provided. Each of the coupling members 35 is composed of a curved member.

The first tooth-hardening member 11 and the coupling members 35 as a whole are simultaneously molded from the same material. The first tooth-hardening member 11 and the coupling members 35 are formed of a material such as TPE (thermoplastic elastomer), and has a hardness (JIS K 6253 A) of 88°. The first surface 11*a* of the first tooth-hardening member 11 is also formed of the same material as that the rest of the first tooth-hardening member 11 and the coupling members 35.

The second tooth-hardening member 32 has the second surface 32*a*, a peripheral part 32*b* at the periphery of the second surface 32*a*, and a holding part 32*c* holding the second surface 32*a* and the peripheral part 32*b*. The second surface 32*a* is formed of TPE different from that of the first tooth-hardening member 11 and the coupling members 35, and has a hardness (JIS K 6253 A) of 55°. The peripheral part 32*b* of the second tooth-hardening member 32 is formed of the same material as that of the first tooth-hardening member 11 and the coupling members 35, and has a hardness (JIS K 6253 A) of 88°.

Thus, the first surface 11*a* of the first tooth-hardening member 11 is harder than the second surface 32*a* of the second tooth-hardening member 32.

As described above, although the second surface 32*a* of the second tooth-hardening member 32 is relatively softer and the peripheral part 32*b* and the holding part 32*c* are relatively harder, the entire second tooth-hardening member 32 may be formed of the same softer material as that of the second surface 32*a*.

The first tooth-hardening member 11 is of substantially a round shape in plane, while the second tooth-hardening member 32 is of a substantially four-leaved shape in plane.

The second tooth-hardening member 32 is so configured as to be firstly directed downward (come close to the first tooth-hardening member 11) from the center portion toward the periphery, and then to be directed upward (separate from the first tooth-hardening member 11) (see, FIG. 11). Each of the coupling members 35 is connected to the second tooth-hardening member 32 at the lowered position.

In this manner, the second tooth-hardening member 32 is so configured as to be firstly directed downward from the center portion toward the periphery and then to be directed upward. Thus, as compared with a constitution in which the second tooth-hardening member 32 is continuously directed upward from the center portion toward the periphery, a height of the second tooth-hardening member 32 can be made smaller. As a result, an entire height of the tooth-hardening apparatus 10 can be restrained.

Similar to the second tooth-hardening member 32, the first tooth-hardening member 11 may also be so configured as to come close to the second tooth-hardening member 32 from the center portion toward the periphery, and then to separate from the second tooth-hardening member 32. In this case, a thickness of the first tooth-hardening member 11 can be made smaller.

As described above, the first surface 11*a* of the first tooth-hardening member 11 is harder than the second surface 32*a* of the second tooth-hardening member 32. Thus, a six-month-old infant can chew the second surface 32*a* to harden his or her teeth through training, while an eight-month-old infant can chew the first surface 11*a* to harden his or her teeth through the training.

The first tooth-hardening member 11 has a space 21 formed substantially in the center portion of the first tooth-hardening member 11. The space 21 is covered with an upper transparent cover 18 and a lower transparent cover 19.

Structures of the upper transparent cover 18 and the lower transparent cover 19 are described below with reference to FIG. 11. As shown in FIG. 11, the space 21 formed in the first tooth-hardening member 11 is covered with the upper transparent cover 18 and the lower transparent cover 19. A plurality of colored balls are contained in the space 21.

When an infant moves the tooth-hardening apparatus 10, the colored balls 20 are moved in the space 21, so that the infant can enjoy itself.

The lower transparent cover 19 is provided with a plurality of drain holes 19*a*. The upper transparent cover 18 and the lower transparent cover 19 are formed of a material such as PP (polypropylene).

Manufacturing steps of the tooth-hardening apparatus 10 is described below.

First, a first tooth-hardening member 11 having a first projection 13 on its surface, a coupling member 35, and a second tooth-hardening member 32 having a second projection 34 on its surface are molded. Since only the second surface 32*a* of the second tooth-hardening member 32 is formed of a material different from that of the rest constituent elements, the first tooth-hardening member 11, the coupling member 35, and the second tooth hardening member 32 are molded by means of a two-color molding. At the same time, an upper transparent cover 18 and a lower transparent cover 19 having drain holes 19*a* are prepared.

Then, the upper transparent cover 18 is positioned above, and the lower transparent cover 19 is positioned below, with the tooth-hardening member 11 being disposed therebetween. A plurality of colored balls 20 are contained in a space 21 between the upper transparent cover 18 and the lower transparent cover 19.

Finally, the upper transparent cover 18 and the lower transparent cover 19 are joined to the tooth-hardening member 11 by an ultrasonic seal. In this way, a tooth-hardening apparatus 10 can be obtained.

When used, a six-month-old infant can chew the second surface 32*a* of the softer second tooth-hardening member 32 to harden his or her teeth through the training.

An eight-month-old infant can chew the first surface 11*a* of the harder first tooth-hardening member 11 to further harden his or her teeth through the training.

When an infant moves the tooth-hardening apparatus 10, the colored balls 20 are moved in the space 21, so that the infant can play with the tooth-hardening apparatus 10 as a toy.

After the tooth-hardening apparatus 10 is used by an infant for a long time, the tooth-hardening apparatus 10 is entirely sterilized by boiling the tooth-hardening apparatus 10. At this time, water vapor may enter the space 21. The water vapor can be discharged through the holes 19*a* as water droplets.

When the colored balls 20 are moved in the space 21, the holes 19*a* have such a function that emits enjoyable sounds by resonating a rattle generated by the colored balls 20.

As described above, according to the present invention, an infant can proceed, corresponding to its growing step, from a step where it chews the softer second surface 32*a*, to a step where it chews the harder surface 11*a*. Therefore, an infant can harden its teeth through training corresponding to its growing step by using a single tooth-hardening apparatus.

The invention claimed is:

1. A tooth-hardening apparatus for a teething infant, comprising:

a plate shaped first tooth-hardening member having an upper surface and a separate lower surface, at least one of the surfaces being provided with a plurality of projections, wherein the plate lies in a plane; and a plate shaped second tooth-hardening member having an upper surface and a separate lower surface, at least one of the surfaces being provided with a plurality of projections;

wherein the plate shaped second tooth-hardening member is arranged at a periphery of the first tooth-hardening member and is extended from the periphery of the plate shaped first tooth hardening member in the plane in which the plate shaped first tooth hardening member lies, the upper and lower surfaces of the first tooth-hardening member and the upper and lower surfaces of the second tooth-hardening member are formed of respective materials which have hardnesses different from each other, and wherein the harder surface of the first tooth-hardening member is harder than the harder surface of the second tooth-hardening member which is arranged at the periphery of the first tooth-hardening member, and both the first and second tooth-hardening members are adapted to be chewed by the infant.

2. The tooth-hardening apparatus according to claim 1, wherein the first hardening member is in the form of an annulus and has a space formed substantially in a center portion of the annulus, the space being contained within two transparent covers which abut one another.

3. The tooth-hardening apparatus according to claim 2, wherein a plurality of colored balls are contained in the space covered with the transparent cover.

4. The tooth-hardening apparatus according to claim 2, wherein the transparent cover is provided with a drain hole.

5. The tooth-hardening apparatus according to claim 1, wherein a gripping opening is disposed on the first tooth-hardening member.

6. The tooth hardening apparatus for a teething infant of claim 1, wherein the hardness of the upper surface of the plate shaped first tooth-hardening member is greater than the hardness of the separate lower surface of the first tooth-hardening member and/or the hardness of the upper surface of the plate shaped second tooth-hardening member is less than the hardness of the separate lower surface of the second tooth-hardening member.

7. The tooth-hardening apparatus for a teething infant of claim 1, wherein the first tooth hardening member is an annular shaped plate and the second tooth hardening member is an oval shaped plate.

* * * * *